United States Patent [19]

McMullen

[11] 4,295,482

[45] Oct. 20, 1981

[54] VALANCE SUPPORT

[76] Inventor: Harold F. McMullen, 5009 E. Colonial Dr., Apt. 14, Tampa, Fla. 33611

[21] Appl. No.: 135,773

[22] Filed: Mar. 31, 1980

[51] Int. Cl.[3] ..... A45F 3/52; A47C 29/00

[52] U.S. Cl. ..... 135/8; 5/414; 135/5.1; 160/19; 248/220.1; 403/384

[58] Field of Search ..... 135/5.1, 8, 5.2; 248/220.1, 300; 5/414; 403/384; 160/19

[56] References Cited

U.S. PATENT DOCUMENTS

| | | | |
|---|---|---|---|
| 849,808 | 4/1907 | Palmer | 135/8 |
| 939,005 | 11/1909 | Goedeke | 248/220.1 X |
| 3,783,931 | 1/1974 | Assael | 248/220.1 X |
| 3,956,784 | 5/1976 | Vargas | 5/414 |

FOREIGN PATENT DOCUMENTS

| | | | |
|---|---|---|---|
| 230927 | 3/1925 | United Kingdom | 135/8 |

*Primary Examiner*—J. Karl Bell
*Attorney, Agent, or Firm*—Stein & Frijouf

[57] ABSTRACT

A novel valance support is disclosed and described. The valance support includes a first and a second side portion disposed at substantially right angles to one another by means of a gusset. A first and a second arm are connected to the first and the second side portions, respectively. Four valance supports are disposed above the four corners of a standard bed and rigidly connected to the ceiling by means of a toggle bolt. Corner draperies are then suspended from the valance support by means of drapery hooks which hook into apertures disposed in the side portions and arms. Such suspension converts a standard bed into what is commonly referred to as a poster bed. The invention further includes an outside ruffle attachment which is secured relative to the valance support. An elastic cord or the like is stretched between each pair of attachments and connected thereto by means of a clip. An outside ruffle may then be disposed around the peripheral edges of the bed and connected to the attachment and the elastic cord by means of drapery hooks. The invention still further includes a bracket which is connected to each valance support and to a canopy which may be suspended above the bed. Finally, the invention also includes extension sleeves which are connected to the first or the second arm to increase the width of the valance support in order to increase the fullness of the corner drapery suspended from the valance support.

11 Claims, 13 Drawing Figures

VALANCE SUPPORT

BACKGROUND OF THE INVENTION

1. Field of the Invention

This invention relates to canopy or poster beds and more particularly, to a novel valance support for converting a standard bed into a canopy/poster bed.

2. Description of the Prior Art

Presently there exists many different types of poster and canopy beds. Basically such beds comprise four upstanding posts which are secured to the main frame of the bed at the four corners thereof. Disposed at the tip of the four posts is a frame structure having a substantially rectangular shape. Corner draperies are typically suspended from the frame structure to hide the posts. Similarly, an outside ruffle is disposed above the peripheral edges of the bed and connected to the horizontal members of the frame structure. Finally, a canopy is suspended over the bed and supported by the rectangular configuration of the frame structure. The combination of the corner draperies, outside ruffle and canopy appeals to a large number of consumers.

Unfortunately, most consumers have previously purchased conventional beds which lack the esthetically pleasing appearance of a poster or canopy bed. U.S. Pat. No. 3,956,784 (Vargas) describes a portable bed canopy which is easily adjustable for any size bed. Such a portable bed canopy comprises four mounted support posts which are spring loaded to engage the ceiling for substantially rigid support for the lightweight canopy elements which enclose the bed. The complexity of the portable bed canopy renders the purchase thereof uneconomically feasible for most consumers.

Therefore it is an object of this invention to provide an apparatus which overcomes the aforementioned inadequacies of the prior art devices and provides an improvement which is a significant contribution to the advancement of the poster bed art.

Another object of this invention is to provide a valance support for converting a standard bed into a poster or canopy bed.

Another object of this invention is to provide a valance support which is relatively simple in construction thereby being economically feasible for the ordinary consumer to purchase.

Another object of this invention is to provide a valance support which is relatively simple in construction such that the average consumer may easily convert his standard bed into a poster or canopy bed.

Another object of this invention is to provide a valance support having a first and a second side portions and a first and a second arms respectively connected thereto for supporting corner draperies suspended therefrom.

Another object of this invention is to provide an elastic cord which is easily connected between each pair of valance supports for suspending the outside ruffle therefrom.

Another object of this invention is to provide a bracket which is connected to the valance support for suspending a canopy above the bed.

Another object of this invention is to provide an outer ruffle attachment which is easily connected to the valance support for displacing the outer ruffle from the valance support.

Another object of this invention is to provide extension sleeves which are easily connected over the arms of the valance support for increasing the width of the valance support in order to increase the fullness of the corner draperies suspended therefrom.

Another object of this invention is to provide a valance support which may be stamped from a sheet of material such as a sheet of metal.

Another object of this invention is to provide a valance support which may be integrally molded from a plastic material by the process of injection molding.

The foregoing has outlined some of the more pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description describing the preferred embodiment in addition to the scope of the invention defined by the claims taken in conjunction with the accompanying drawings.

SUMMARY OF THE INVENTION

The invention is defined by the appended claims with a specific embodiment shown in the attached drawings. For the purpose of summarizing the invention, the invention may be utilized to suspend corner draperies along each corner of the bed, to suspend an outside ruffle which runs along the peripheral edges of the bed and to support a canopy above the bed.

A valance support is secured to the ceiling above each of the four corners of the bed by means of toggle bolts or the like. The valance support comprises a first and a second arm respectively secured to a first and a second side portion. The two side portions are disposed at substantially right angles to one another by means of a gusset. A toggle bolt or the like is threaded through a hole in the gusset to secure the valance support to the ceiling. An outside ruffle attachment comprising a first and a second element disposed at substantially right angles to one another by means of a gusset is similarily connected to the ceiling by means of the toggle or the like. An elastic cord is stretched between each pair of valance supports and connected thereto by means of a clip which hooks into apertures disposed in the outside ruffle attachment.

During assemblage, the valance support together with the outside ruffle attachment is secured above each of the four corners of the bed by means of the toggle bolt. The corner draperies are then suspended from the valance support by means of drapery hooks which hook into apertures disposed in the first and second side portions and the first and second arms of the valance support. The outside ruffle is then connected to the outside ruffle attachment and to the elastic cord by similar drapery hooks. The canopy is suspended over the bed by means of reinforcement members which are sewn to each of the four corners of the canopy. A hook means is riveted to each of the reinforcement members and then connected to the valance support by means of a bracket. As can be readily seen, the construction of the present invention is relatively simple. Such simplicity enables the average consumer to easily convert his conventional bed to a poster/canopy bed.

The fullness of the corner draperies is determined by the width of the first arm and first side portion and second arm and second side portions. Accordingly, increasing such width increases the fullness of the corner draperies, and likewise, decreasing such width decreases the fullness of the corner draperies. The valance support of the subject invention incorporates a means for decreasing or increasing such width. Specifically, a series of indentations is disposed between the first arm and the first side portion and the second arm and the second side portion. The first arm or the second arm may be broken off of the first side portion or the second side portion, respectively, thereby decreasing the width of the valance support. An extension sleeve has been provided to similarily lengthen the width of the valance support. The extension sleeve is connected over the first arm or the second arm and is connected thereto by means of an integral tab which correspondingly fits into a slot disposed in the first and the second arm.

It is noted that the valance support together with the outside ruffle attachment may be stamped from a sheet of material such as a sheet of metal. The valance support and the attachment may then be folded in order to create the configuration previously described. Alternatively, the valance support or the attachment may be integrally molded from a plastic material. Such a molding could be accomplished through the well known art of injection molding. It is further noted that other means for connecting the corner draperies and the outside ruffle to the valance support and to the elastic cord and outside ruffle attachment, respectively, may be suitable. Specifically, such connecting means may be a fastening means such as a fastener sold under the Trademark Velcro.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION

Figure 1:
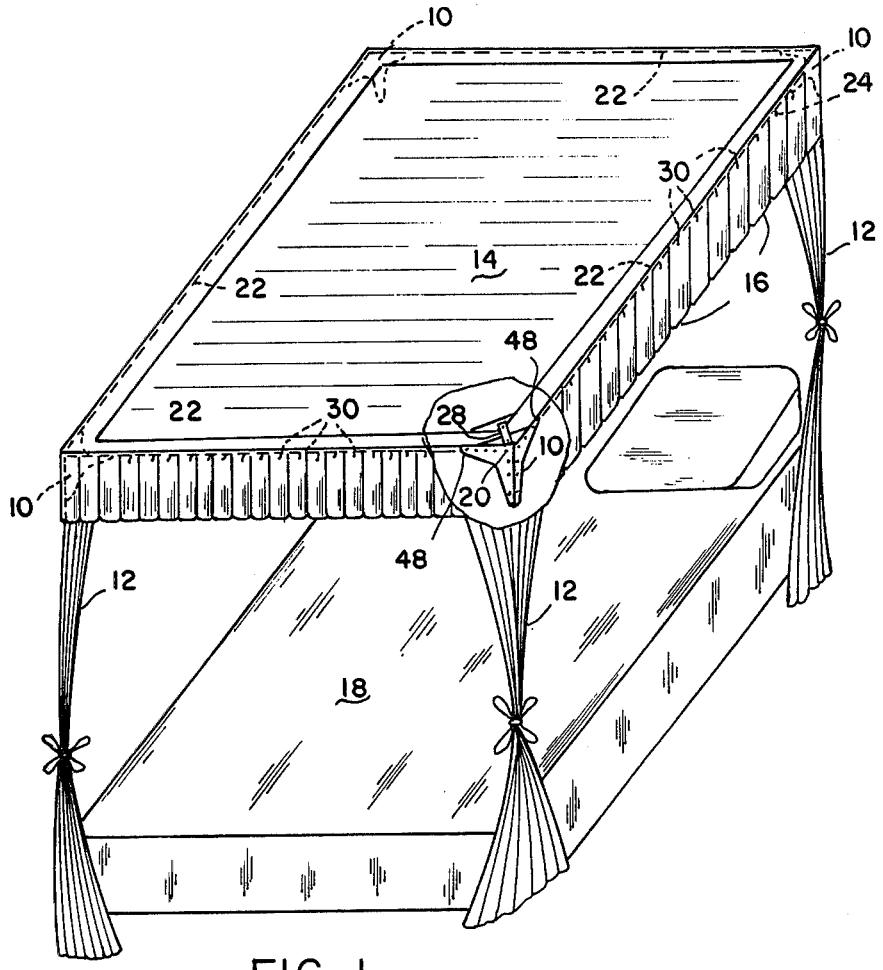
FIG. 1 is a perspective view of the invention used to convert a standard bed into a poster-type bed.

FIG. 1 is a perspective view of valance support 10 used to support corner draperies 12, canopy 14 and outside ruffle 16. More particularly, four valance supports 10 are disposed above each of the four corners of the bed 18 and secured to the ceiling by means of toggle bolts or the like which are inserted through hole 20 and secured to the ceiling. An elastic cord 22 is stretched between each of the valance supports 10. The corner draperies 12 are suspended from the valance supports 10 by means of drapery hooks 24 which hook through apertures 26 in the valance support 10. The canopy 14 is suspended above the bed 18 by means of brackets 28 secured to each of the four valance supports 10. The outside ruffle 16 is suspended from the valance support 10 and the elastic cord 20 by means of drapery hooks 30 which hook into apertures 26 and over the elastic cord 20, respectively. As can be readily seen, the use of the four valance supports 10 disposed above the four corners of the bed gives the appearance that the bed is what is commonly referred to as a poster/canopy bed.

Figure 2:
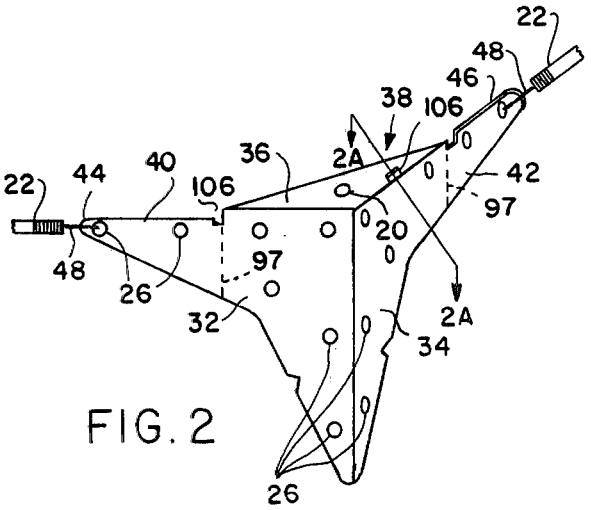
FIG. 2 is a perspective view of the invention showing the first and second side portions disposed at substantially right angles to one another.

FIG. 2 is a perspective view of the first embodiment of valance support 10. Valance support 10 comprises a first side portion 32 and a second side portion 34 disposed at substantially right angles to one another. A gusset 36 is disposed at the upper end of first portion 32 and is secured to the upper end of the second portion 34 by a latch means 38. Extending from first side portion 32 and second side portion 34 is a first arm 40 and second arm 42, respectively. A plurality of apertures are disposed in the first and second side portions 32 and 34 and in the first and second arms 40 and 42. As noted earlier, the corner draperies 12 are suspended from the valance support by means of drapery hooks 24 which hook into apertures 26. Accordingly, the fullness of the corner drapery 12 is determined by the width of the first side portion 32 and first arm 40 and the width of the second side portion 34 and second arm 42.

The elastic cord 20 is stretched between each of the valance supports 10. Elastic cord 20 is connected to the corners 44 and 46 of the first and second arms 40 and 42, respectively. More particularly, a clip 48 is connected to the terminal end of the elastic cord 20 and hooks into the aperture 26 disposed in each of the corners 44 and 46.

Figure 2A:
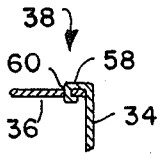
FIG. 2A is a cross-sectional view of FIG. 2 along line 2A—2A showing the first embodiment of the latch means.
Figure 3:
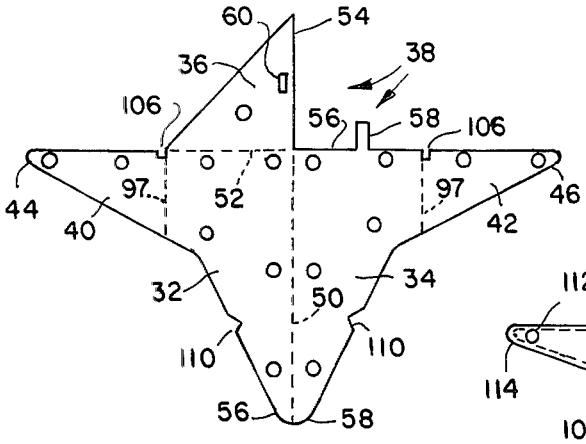
FIG. 3 is a plan view of FIG. 2.

FIG. 3 is a plan view of the first embodiment of valance support 10 showing the configuration of the pattern which may be used to stamp the valance support 10 from a sheet of material such as a sheet of metal. Specifically, the pattern shown in FIG. 3 may be folded along fold line 50 such that the first and second side portions 32 and 34 are at substantially right angles to one another. The gusset 36 is then folded along fold line 52 to create the configuration as shown in FIG. 2. Latch means 38 then secures the edge 54 of gusset 36 to the upper edge 56 of second side portion 34. Latch means 38 comprises an integral tab 58 which is inserted into slot 60 as shown in FIG. 2A. It is noted that latch means 38 may alternatively comprise tack welding or the like.

Figure 4:
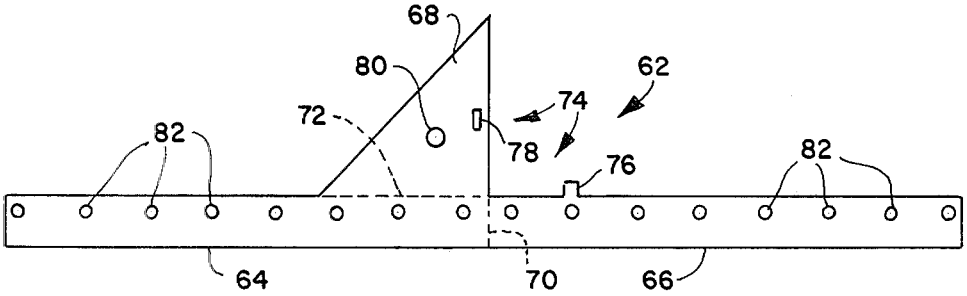
FIG. 4 is a plan view of the outside ruffle attachment.
Figure 8:
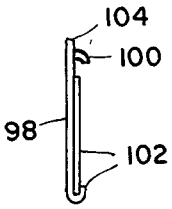
FIG. 8 is a side view of the extension sleeve.

FIG. 4 shows a pattern of the outside ruffle attachment 62. Such a pattern may be stamped from a sheet of material similar to the stamping of the valance support 10 mentioned above. Specifically, attachment 62 comprises a first element 64, a second element 66 and a gusset 68. The first and second elements 64 and 66 are folded along fold line 70 to be at substantially right angles to one another. Gusset 68 is then folded along fold line 72 and latched to the second element 66 by latch means 74. Similar to latch means 38, latch means 74 comprises an integral tab 76 which is inserted into slot 78. In operation, the outside ruffle attachment 62 is placed over valance support 10 as shown in FIG. 8. A toggle bolt or the like is then inserted through hole 20 in the valance support 10 and hole 80 and secured to the ceiling. A series of apertures 82 are disposed in the first and second elements 64 and 66. The elastic cord 22 is stretched between each pair of outside ruffle attachments 62 and connected thereto by means of clip 48. The outside ruffle 16 is then connected to the elastic cord 22 and attachment 62 by means of drapery hooks 30 which hook over the elastic cord 22 and hook into apertures 82. As can be readily seen, the outside ruffle attachment 62 provides a means to displace the outside ruffle 16 from the corner draperies 12 which are connected to valance support 10.

Figure 5:
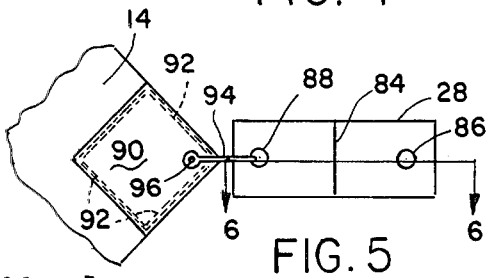
FIG. 5 is a top view of the bracket which connects the canopy to the valance support.
Figure 6:
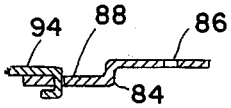
FIG. 6 is a cross-sectional view of FIG. 5 along lines 6—6.
Figure 7A:
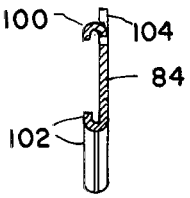
FIG. 7A is a cross-sectional view of FIG. 7 along lines 7A—7A.

FIGS. 5 and 6 are a top view and cross-sectional view, respectively, of the means for securing the canopy 14 to the valance support 10. More particularly, such securing means comprises a bracket 28 having a bend 84 at its midsection. A hole 86 is disposed at one end of the bracket 28 such that the bracket 28 may be connected to the valance support 10 by means of the toggle bolt or the like mentioned previously. The corner of the canopy 14 is reinforced by a reinforcement member 90 which is rigidly secured thereto by means of stitching 92. A hook means 94 is rivited to the reinforcement member 90 by a rivet 96. The corner of the canopy 14 is then hooked into aperture 88 disposed at the other end of bracket 28. As can be readily seen, the canopy 14 may be easily removed from the valance support 10 by disconnecting the hook means 94 from aperture 88. As noted earlier, the width of valance support 10 determines the fullness of corner draperies 12. As best shown in FIGS. 2 and 3, provision is made to shorten such width in order to decrease the fullness of corner draperies 12. Specifically, a series of indentations 97 is disposed between the first arm 40 and first side portion 32 and between the second arm 42 and second side portion 34. Such indentations 97 enables the first arm 40 or the second arm 42 to be broken off of the first side portion 32 and the second side portion 34, respectively. The width of the valance support 10 is accordingly reduced.

Figure 7:
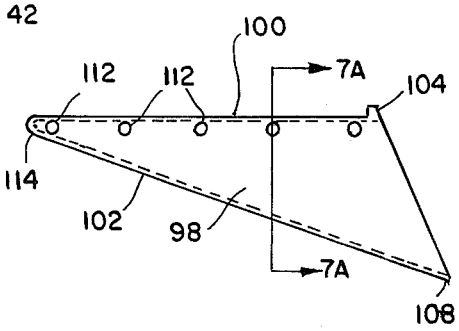
FIG. 7 is a front view of the extension sleeve.
Figure 9:
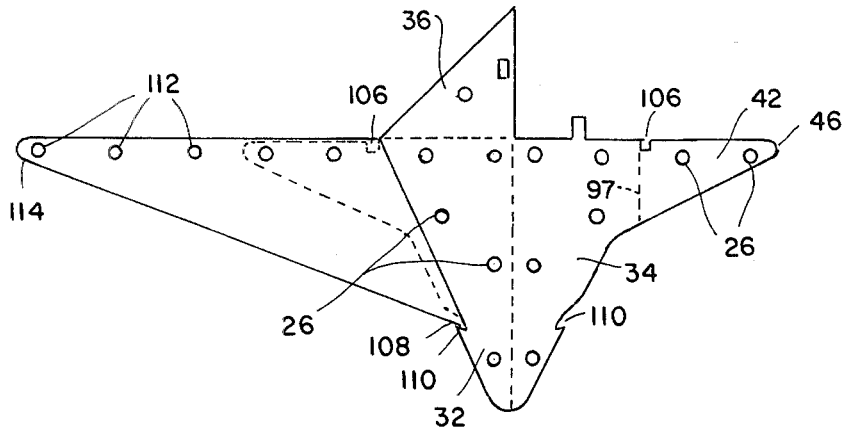
FIG. 9 is a plan view of the valance support together with the extension sleeve.

FIGS. 7, 8 and 9 show a means for extending the width of the valance support 10. Such extension means comprises an extension sleeve 98 which is secured to the first and second arms 40 and 42 of the valance support 10. More particularly, extension sleeve 98 comprises a substantially triangular configuration which may be stamped from a sheet of material. The edges 100 and 102 thereof may be curled in order to strengthen the sleeve 98. During assembly, extension sleeve 98 is secured to either the first or the second arm 40 and 42 by means of an integral tab 104 which correspondingly bends into a slot 106 disposed in either the first or second arm 40 and 42. The lower corner 108 of the extension sleeve then rests in indentation 110 disposed in the first and second side portions 32 and 34. The corner draperies 12 are then suspended from the extension sleeve 98 by means of drapery hooks 24 which hook into apertures 112 disposed in the extension sleeve 98. If the outside ruffle attachment 62 is not utilized as explained previously, the elastic cord 22 may be connected to the aperture 112 disposed in the corner 114 of the extension sleeve 98. The outside ruffle 16 may then be connected to the elastic cord by means of drapery hooks 30.

Figure 10:
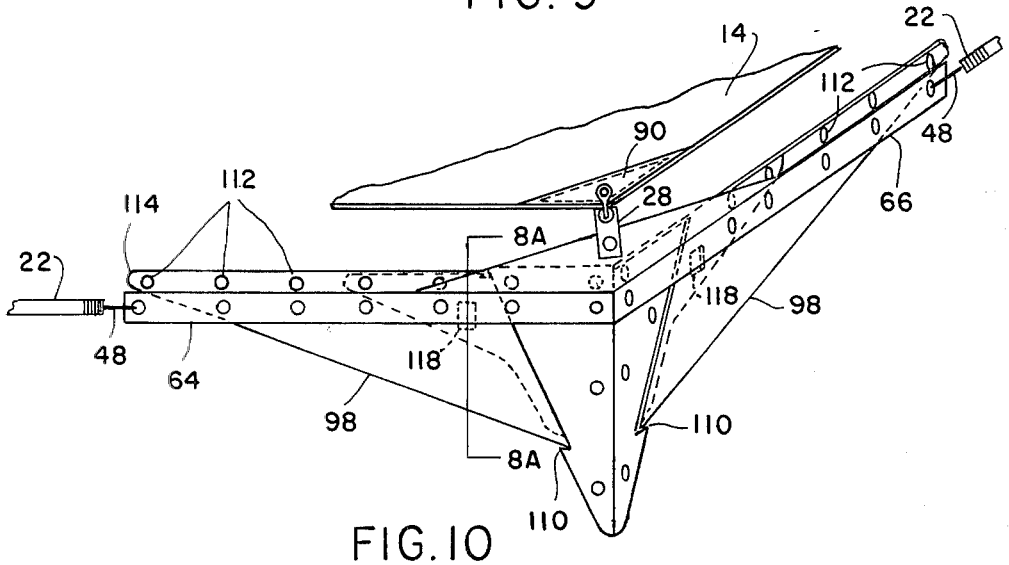
FIG. 10 is a perspective view of the valance support together with the extension sleeves, outer ruffle attachment and the bracket which connects the canopy to the valance support.

FIG. 10 is a perspective view of the valance support 10 together with the combination of brackets 28, extension sleeves 98 and outside ruffle attachment 62. As noted earlier, corner draperies 12 are suspended from extension sleeves 98 by means of drapery hooks 24. Similarly, the outside ruffle 16 is suspended from elastic cord 22 and attachment 62 by means of drapery hooks 30. Finally, canopy 14 is stretched between the valance supports 10 by means of bracket 28.

Figure 10A:
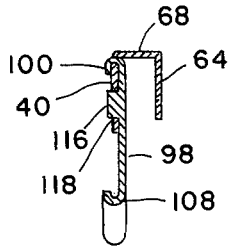
FIG. 10A is a cross-sectional view of FIG. 10 along lines 10A—10A showing the outer ruffle attachment displaced away from the valance support and showing the extension sleeve connected to the arm by means of a protuberance which snaps into an aperture disposed in the arm.

It is noted that valance support 10 may be molded from a plastic or other suitable material. FIG. 10 shows such a valance support 10 which is manufactured by the process of injection molding. Similarly, extension sleeve 98 and outside ruffle attachment 62 may be similarly made by injection molding. Extension sleeve 98 would connect to the first and second arms 40 and 42 by means of a protuberance 116 which correspondingly snaps into aperture 118 as shown in FIG. 10A.

It will thus be seen that the objects set forth above, among those made apparent from the preceding description, are efficiently attained and since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

I claim:

1. A valance support for supporting a corner drapery from a ceiling, comprising in combination:

a first side portion;

a second side portion disposed at substantially right angles to said first side portion;

a first arm connected to said first side portion;

a second arm connected to said second side portion;

a valance gusset disposed in the upper corner formed by said first side portion and said second side portion;

means for hanging the corner drapery from said first and second side portions and said first and second arms; and means for securing said valance support to the ceiling.

2. The valance support as set forth in claim 1, further including means for connecting a canopy between four of said valance supports.

3. The valance support as set forth in claim 2, wherein said connecting means includes a bracket which is connected to said valance support;

a reinforcement member secured to each corner of the canopy; and rivet means securing said reinforcement member relative to said bracket.

4. The valance support as set forth in claim 1, further comprising means for suspending an outside ruffle between two of said valance supports.

5. The valance support as set forth in claim 4, wherein said means for suspending the outside ruffle includes a cord secured to one of said first arms and said second arms; and drapery hooks connected to the outside ruffle which hook over said cord.

6. The valance support as set forth in claim 4, wherein said means for suspending the outside ruffle includes;

an outside ruffle attachment secured relative to said valance gusset;

said attachment including a first element and a second element which are disposed at substantially right angles to one another;

an attachment gusset disposed in the corner formed by said first element and said second element;

a cord connected to one of said first element and said second element; and means for connecting the outside ruffle to said first element and said second element and said cord.

7. The valance support as set forth in claim 1, further including:

an extension sleeve for extending the width of said valance support;

means for connecting said extension sleeve to said valance support; and means for suspending the corner drapery from said extension sleeve.

8. The valance support as set forth in claim 7, wherein said means for connecting said extension sleeve to the valance support comprises in combination:

a tab integrally connected to said extension sleeve which mates with a slot in said arms;

the edges of said extension sleeve being curled; and an indentation in said side portions for receiving the curled end of said extension sleeve.

9. The valance support as set forth in claim 1, wherein said side portions, said valance gusset and said arms are stamped from a sheet of material.

10. The valance support as set forth in claim 6, wherein said outside ruffle attachment is stamped from a sheet of material.

11. The valance support as set forth in claim 1, wherein said side portions, said gusset and said arms are integrally molded with one another from a plastic material.

* * * * *